US006971444B2

(12) United States Patent
Lamich

(10) Patent No.: US 6,971,444 B2
(45) Date of Patent: Dec. 6, 2005

(54) HEAT EXCHANGER CONSTRUCTION AND METHOD

(75) Inventor: Bernhard Lamich, Racine, WI (US)

(73) Assignee: Modine Manufacturing Company, Racine, WI (US)

( * ) Notice: Subject to any disclaimer, the term of this patent is extended or adjusted under 35 U.S.C. 154(b) by 275 days.

(21) Appl. No.: 10/086,237

(22) Filed: Feb. 27, 2002

(65) Prior Publication Data

US 2002/0138981 A1 Oct. 3, 2002

(30) Foreign Application Priority Data

Mar. 22, 2001 (DE) ..... 101 14 078

(51) Int. Cl.[7] ..... F28F 9/04
(52) U.S. Cl. ..... 165/173; 165/175; 165/178
(58) Field of Search ..... 165/173–178; 29/890.043, 890.052

(56) References Cited

U.S. PATENT DOCUMENTS 3,589,440 A * 6/1971 Friedrich ..... 165/178
3,972,371 A * 8/1976 Plegat ..... 165/178
4,513,811 A * 4/1985 Lesniak ..... 165/173
4,813,112 A * 3/1989 Pilliez ..... 29/890.043
5,067,235 A * 11/1991 Kato et al. ..... 29/890.043
5,457,885 A * 10/1995 Ohashi et al. ..... 165/153
5,762,133 A * 6/1998 Dion ..... 165/173

FOREIGN PATENT DOCUMENTS

DE 694 02 786 T2 7/1997
DE 197 57 034 A1 6/1999
DE 697 00 090 T2 6/1999
JP 05157488 A * 6/1993 ..... 165/173

* cited by examiner

*Primary Examiner*—Leonard R. Leo
(74) *Attorney, Agent, or Firm*—Wood, Phillips, Katz, Clark & Mortimer

(57) ABSTRACT

A heat exchanger construction (10) including a plurality of flat heat exchanger tubes (12) and a tube plate (18). The tube plate (18) has an exterior side (20), an interior side (22), and a plurality of tube openings (24) spaced along a longitudinal axis (26). Each of the tubes (12) includes a pair of opposed long sides (29) and a pair of opposed short sides (30). Each of the tubes (12) has an end (34) received in one of the tube openings (24) and extending past the interior side (22). Each of the ends (34) includes a pair of long edges (36) defined by the long sides (28). Each of the tubes (12) has a cut (38) in each of its short sides (30) extending from the end (34) to adjacent the interior side (22) of the tube plate (18). Each of the tubes further includes a bend (40) formed in each of the long sides (28) of the tube (12) adjacent the cut (38) so that the long edges (36) of the tube (12) are adjacent the long edges (36) of the tube (12) on either side of the tube (12).

5 Claims, 4 Drawing Sheets

HEAT EXCHANGER CONSTRUCTION AND METHOD

FIELD OF THE INVENTION

This invention relates to heat exchangers, and more particularly to heat exchangers utilizing flat tubes that are inserted into openings in a header or tube plate that forms part of a manifold for the heat exchanger.

BACKGROUND OF THE INVENTION

Heat exchangers are known that include a plurality of parallel, flat tubes that are inserted into a plurality of corresponding tube openings in a header or tube plate that forms part of the manifold for the heat exchanger, with the ends of the tubes on the interior side of the header or tube plate being flared outwardly to a size greater than the tube openings in the header or tube plate. One such heat exchanger is shown in DE 198 57 435 801 wherein a diversion plate is provided on the interior side of the tube plate to reduce the flow resistance for the inflow and outflow of the working fluid to and from the tubes. However, it can be seen that the diversion plate adds complication to construction of the heat exchanger.

SUMMARY OF THE INVENTION

It is the principal object of the present invention to provide a new and improved heat exchanger construction.

It is another object of the invention to provide a heat exchanger construction wherein the pressure drop associated with the inflow and outflow of the working fluid to and from the tubes is minimized in a relatively cost effective manner in comparison to conventional heat exchanger constructions.

At least some of the above identified objects are obtained in a heat exchanger construction including a header plate and a plurality of elongated flat tubes. The header plate includes an interior side, an exterior side, and a plurality of tube openings spaced along a first axis and extending between the interior and exterior sides. Each of the flat tubes has a pair of opposed long sides and a pair of opposed short sides. Each of the tubes has an end received in one of the tube openings extending past the interior side, with each end including a pair of long edges defined by the long sides. Each tube has a cut in each of its short sides extending from the end to adjacent the interior side of the header plate, and a bend formed in each of the long sides of the tube adjacent the cut so that the long edges of the tubes are adjacent the long edges of the tubes on either side of the tube.

In one form, the length of each of the long sides extending past the interior side of the header plate is approximately equal to half of the distance between the tube openings.

According to one form, each of the bends is a substantially 90° bend.

In one aspect, each of the tube openings includes a peripheral flange on the interior side of the header plate.

In one form, each of the long sides between the long edges in the bends of the tubes are substantially parallel to the first axis.

According to one aspect, the long edges of each tube are overlapped with the long edges of the tube on either side of the tube.

In one aspect, the heat exchanger construction further includes a tank surrounding the interior side and the tube ends. The tank includes an inlet opening for a working fluid. For each adjacent pair of long edges, the long edge of the tube closer to the inlet opening overlays the long edge of the next tube further from the inlet opening.

In accordance with one aspect of the invention, a method is provided for producing a heat exchanger construction including a plurality of elongated flat tubes and a header plate. Each of the tubes has a pair of opposed long sides and a pair of opposed short sides. Each of the tubes has an end with a pair of long edges defined by the long sides. The method includes the steps of arranging the plurality of the elongated flat tubes into a block of parallel flat tubes, inserting the ends of the tubes as a group into corresponding tube openings in a header plate so that each of the ends extend pass an interior side of the header plate by a predetermined distant, after the inserting step, cutting the short side of each tube between the tube end and the interior side of the header plate, after the cutting step, bending the long side of each tube so that the long edges of each tube are placed adjacent the long edges of the tube on either side of the tube.

In one form, the cutting and bending steps are performed in one work step.

Other objects and advantages of the invention will become apparent after review of the specification, including the appended claims and drawings.

DETAILED DESCRIPTION OF THE PREFERRED EMBODIMENTS

Figure 1:
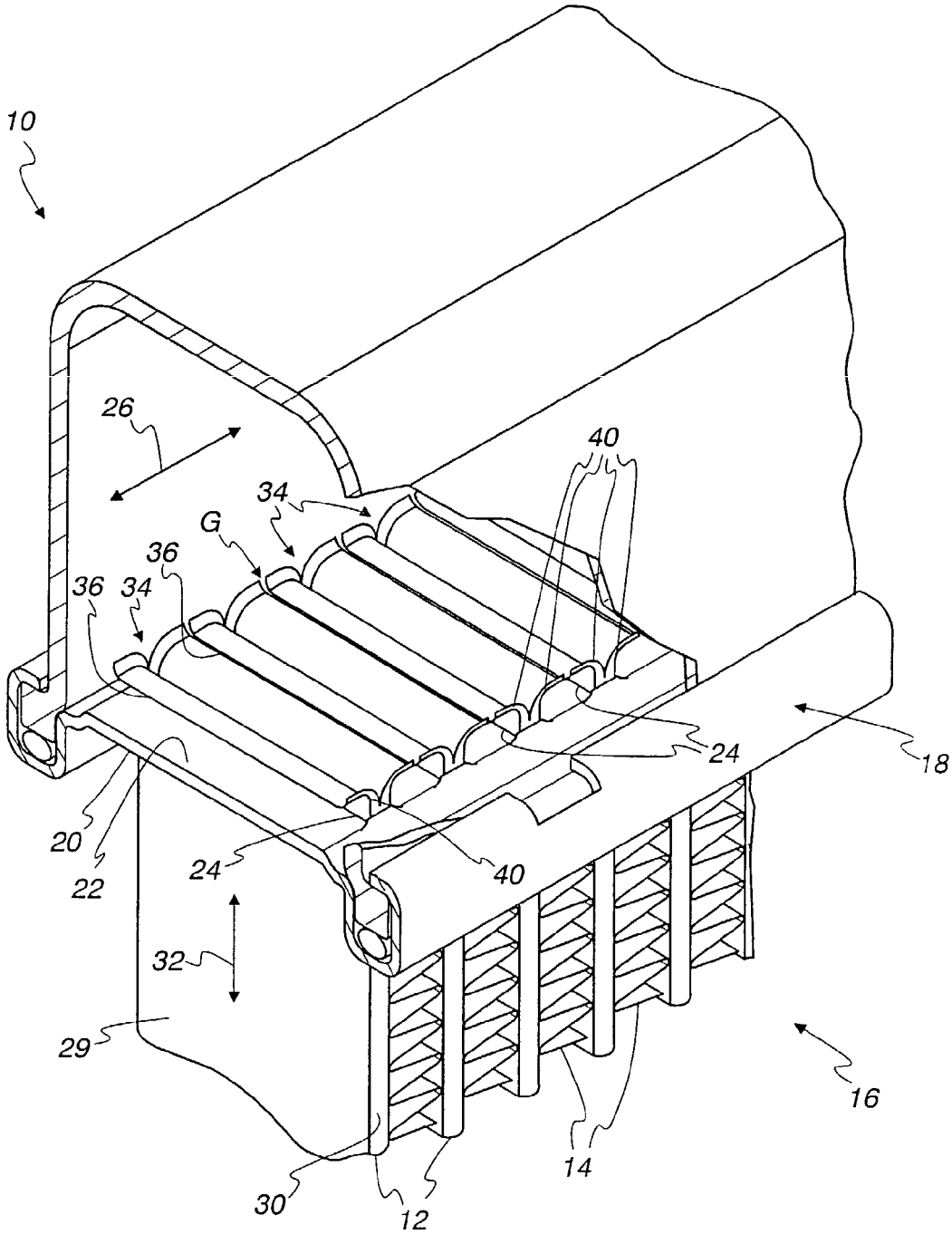
FIG. 1 is a perspective view, partially in section showing a portion of a heat exchanger construction embodying the present invention.

With reference to FIG. 1, a heat exchanger construction 10 embodying the invention includes a plurality of flat heat exchanger tubes 12 in fins 14 extending therebetween to form a so called fin/tube block 16. The heat exchanger construction 10 further includes a header or tube plate 18 having an exterior side 20, an interior side 22, and a plurality of tube openings 24 spaced along an axis 26 and extending between the exterior and exterior sides 20 and 22. A tank 27 surrounds the interior side 22 of the tube plate 18 to define a manifold for the heat exchanger. In the illustrated embodiment, each of the openings 24 includes a peripheral flange 28 protruding on the interior side 22 of the tube plate 18. Typically, a similar combination of a tube plate 18 and a tank 27 will be provided at the opposite end of the tube block 16 (not shown).

Figure 2:
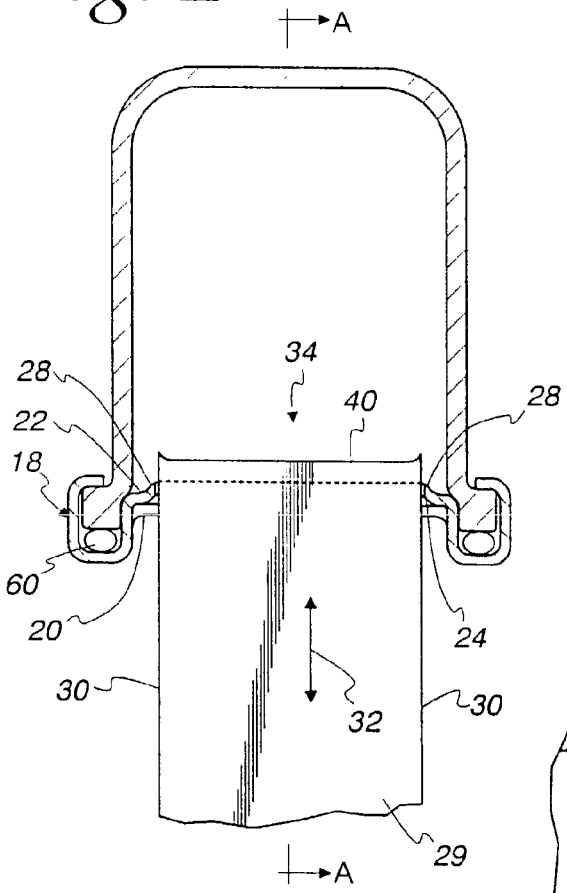
FIG. 2 is a section view of FIG. 1.
Figure 3:
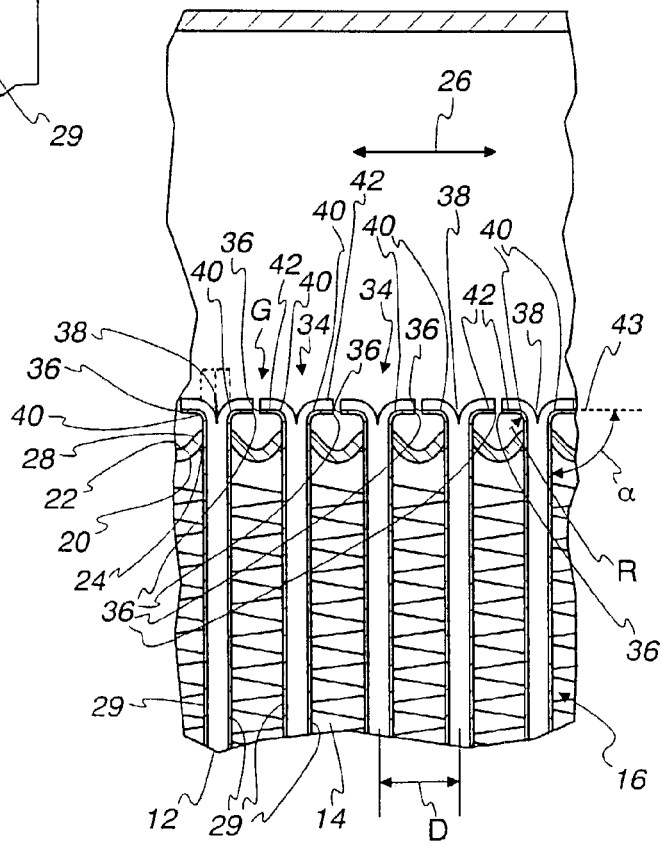
FIG. 3 is a section view taken along line A—A in FIG. 2.

Each of the flat tubes 12 include a pair of opposed long sides 29 and a pair of opposed short sides 30, as measured transverse to a longitudinal axis 32 of the tube 12 as best seen in FIGS. 1–3. Each of the tubes 12 has an end 34 received in one of the tube openings 24 and extending past the interior side 22 by a predetermined distance. Each of the ends 34 includes a pair of long edges 36 defined by the long sides 29. Further, each of the tubes 12 has a cut 38 in each of its short sides 30 extending from the end 34 to adjacent the interior side 22 of the tube plate 18. In this regard, while the cut 38 shown in FIGS. 1–3 and 6 is essentially a slit formed in each of the short sides 30, as seen in FIG. 7, the cut 38 can result in the removal of a slug 39 of material from each of the short sides 30 so that the short sides 30 between each of the ends 34 and the interior side of the tank plate 18 do not project substantially into the interior of the tank 27. This is desirable in tubes 12 having short sides 30 that are wider, such as may be used in intercoolers. Each of the tubes 12 also includes a bend 40 having a radius R formed in each of the long sides 29 of the tube 12 adjacent the cut 38 to place the long edges 36 of the tube 12 adjacent the long edges 36 of the tubes 12 on either side of the tube 12. As seen in the illustrated embodiment shown in FIGS. 3, 6, and 7, a portion 42 of each of the long sides 29 extending between the long edges 36 and bends 40 is substantially parallel to the first axis 26 and the plane of the tube plate 18. Preferably, the portions 42 lie in a common plane indicated by the dash line 43 in FIGS. 3, 6, and 7.

Figure 6:
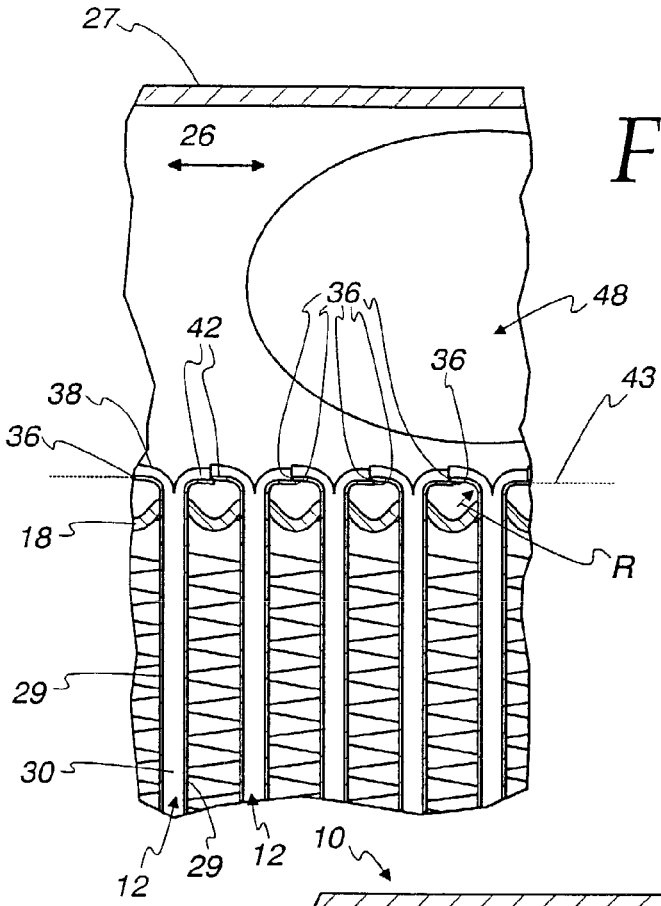
FIG. 6 is a view similar to FIG. 3 showing another embodiment of the heat exchanger construction.
Figure 7:
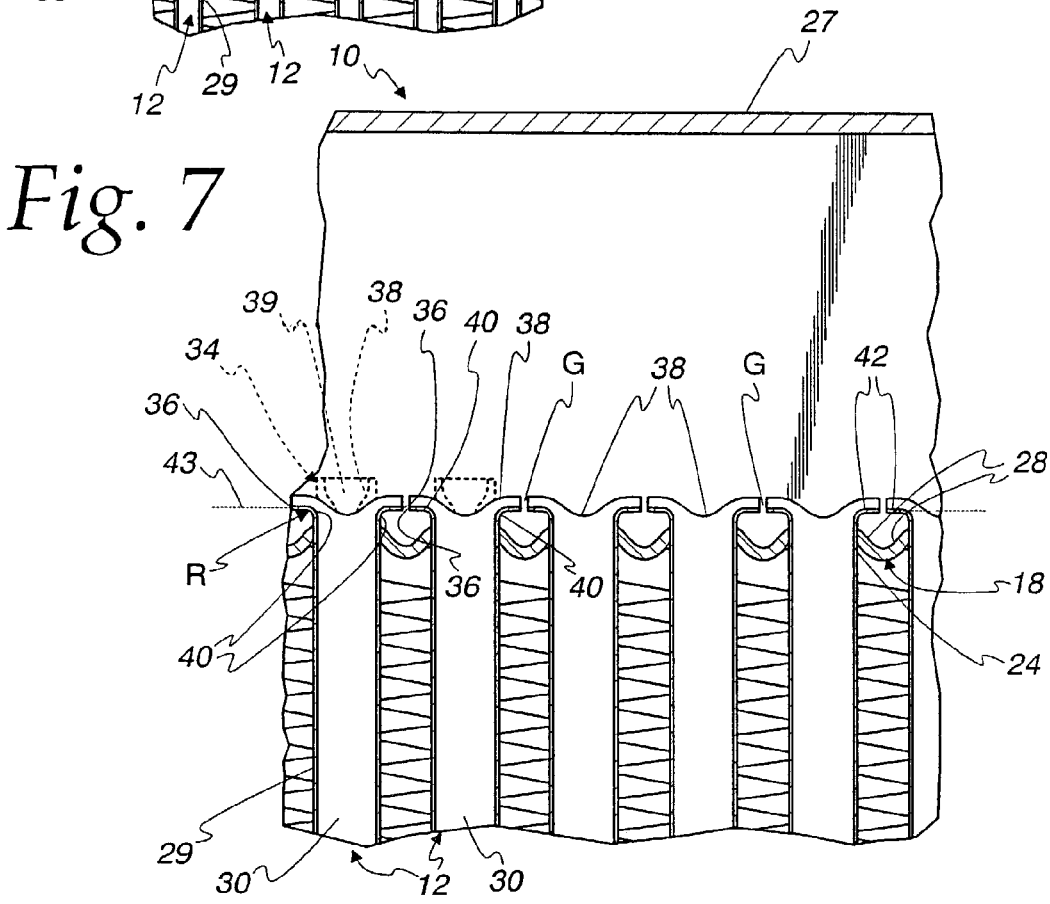
FIG. 7 is a view similar to FIGS. 3 and 6 showing yet another embodiment of the heat exchanger construction.

As best seen in FIGS. 3 and 6, it preferred that the length of each of the long sides 29 extending past the interior side 22 of the tube plate 18, is approximately equal to half the distant D between the tube openings 24 and the heat exchanger tubes 12 taking into consideration the bend radius R. This provides little or no gap G between the long edges 36, and as seen in FIG. 6, can result in the long edges 36 overlapping. In this regard, length tolerances of the heat exchanger tubes 12 can affect the foregoing. Preferably, the gap G is small enough that it can be, but does not have to be, filled with braze in a subsequent brazing operation so as to form a good joining between the adjacent long edges 36. Additionally, in the preferred embodiments shown in FIGS. 3 and 6, the bending angle $\alpha$ is approximately 90° or sightly less than 90°. In this regard, the rigidity of the bends 40 is improved if the bend is somewhat less than 90°, for example 85° to 89°. In some embodiments where the tube plate 18 is highly deformed, the angle $\alpha$ may be somewhat greater than 90°. Further, it should be appreciated that the bend radius R can be substantially smaller than that shown in FIGS. 3, 6 and 7 so that the portions 42 of the long sides 29 can be closer to the interior side 22 of the tube plate 18.

As seen in FIG. 6, the tank 27 can be provided with an inlet opening 48, in which case it is preferred that, if the long edges 36 overlap, that the long edge 36 of the tube 12 closer to the inlet opening 48 overlay the long edge 36 of the next tube 12 further from the inlet opening 48, as seen in FIG. 6.

The heat exchanger construction 10 is formed in a method wherein all of the ends 34 are inserted into the openings 24 of the tube plate 20 prior to the formation of the bends 40 and the cuts 38, as shown in phantom on the two left hand tubes in FIGS. 3 and 7. The cuts 38 and the bends 40 are then formed in a single work step simultaneously on all of the ends 34.

Figure 4:
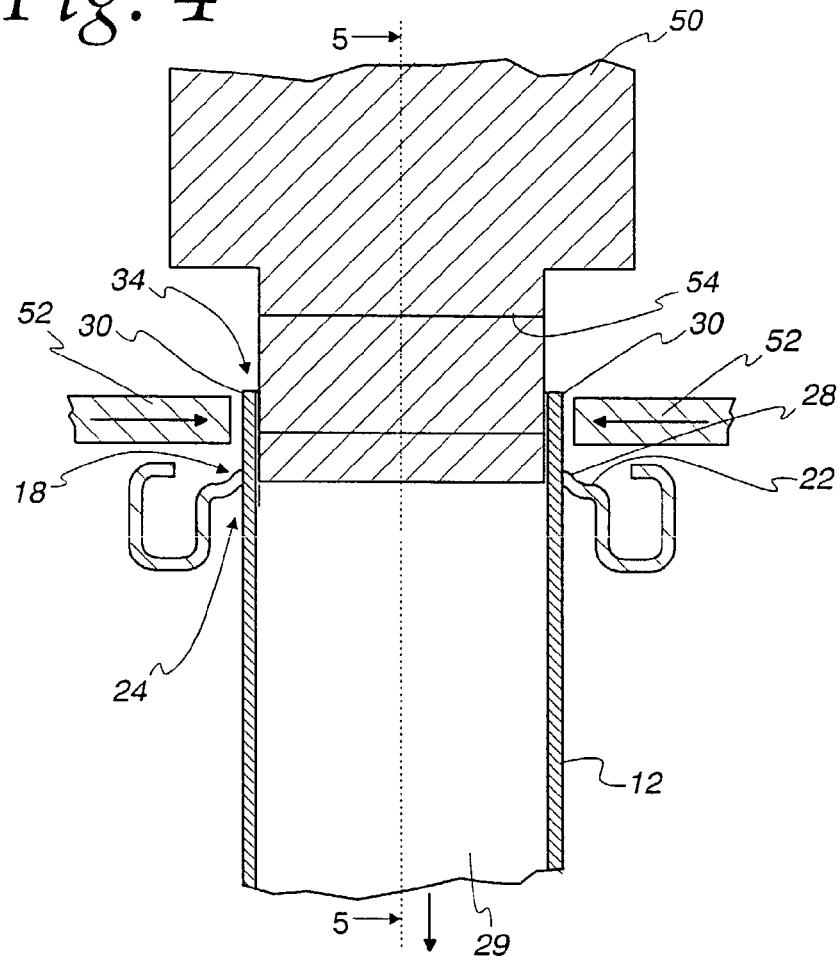
FIG. 4 is a view similar to FIG. 3 showing a work step in the fabrication of the heat exchanger construction shown in FIG. 1.
Figure 5:
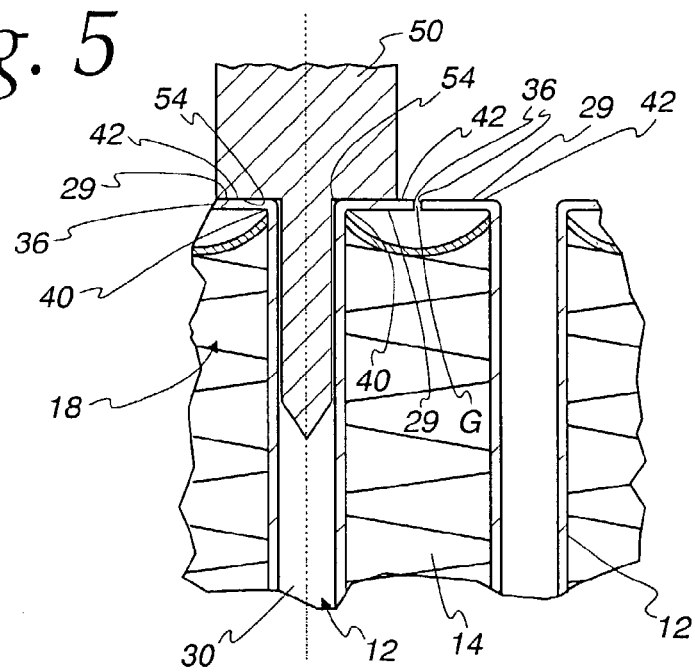
FIG. 5 is a view taken from line 5—5 from FIG. 4 showing a further sequence of the work step of FIG. 4.

More specifically, the tubes 12 and the fins 14 are first stacked alternatively to form the fin/tube block 16. The ends 34 are then inserted as a group into the openings 24 of the tank plate 20, preferably with an excess length extending past the interior surface 22 by approximately half the distant D between the tubes 12 so that the long edges 36 can be placed adjacent to each other. As best seen in FIG. 4 with respect to a single tube 12, after the end 34 of the tube 12 is inserted into the openings 24, a bending stamp 50 is introduced into the end 34 of the tube 12 to stabilize the tube 12 and form a counter bearing for two blanking or cutting punches 52 that work on the two narrow sides 30 of the tube 12 to make the cut 38 therein. It should be understood that while FIG. 4 illustrates this production or work step with respect to one of the tubes 12, in the preferred method each of the tube ends 34 are being simultaneously worked by their own corresponding set of stamps 50 and punches 52. As best seen in FIG. 5, again for illustration purposes shown for just one of the tubes 12, after the cuts 38 are formed by the punches 52, the bending stamps 50 is introduced deeper into the end 34 until bending edges 54 of the bending stamp 50 act on the long sides 29 to form the bends 40, which are shown to be approximately 90°. It follows that the forming tool for the method has a number of the bending stamps 50 and pairs of blanking punches 52 equal to the number of ends 34 of the tubes 12 extending from the tube plate 18, so that all of the tube ends 34 can be formed simultaneously during one work step as shown.

It should be appreciated from the drawings that the bends 40 can hold the tube/fin block 16 securely together by the tube plate 18, so that no auxiliary fixturing is required for the bonding process, which is preferably brazing. Further, it should be appreciated that an excellent braze joint is possible between the tubes 12 and the openings 24 because the bending stamp 54 brings the long sides 29 of the tubes 28 closer to the openings 24 in the area adjacent the bends 40.

It can be seen that the bends 40 flow favorable surfaces in the long sides 29 that direct the working fluid into the interior of the tubes 12 and/or from the interior of the tubes 12 with a reduced pressure loss in comparison to conventional construction wherein such flow favorable surfaces are not formed. This can be particularly advantageous in tube plates 18 that are more highly deformed and therefore more stable, which deformation typically results in a greater pressure loss which can be avoided or reduced as a result of the flow-favorable surface provided by the heat exchanger construction 10. The more highly deformed tube plate makes it possible to employ smaller sheet thickness, which naturally is a factor is saving cost. Thus, the heat exchanger construction 10 can allow for the use of a highly deformed tube plate 18 and its associated benefits, without necessarily incurring the increased pressure loss normally associated with highly deformed tube plates 18.

While the invention has been described herein in connection with a particular form of tube plate 18 and tank 27, it should be appreciated that the invention can find use in many known forms of tube plate 18 and tank 27. For example, while in the illustrated embodiments the peripheral flanges 28 protrude towards the interior side 22 of the tank plate 18, it maybe advantageous to some applications to utilize a tank plate that includes peripheral flanges 28 that protrude toward the exterior side 20 of tank plate 18. By way of further example, while the illustrated embodiment shown in FIGS. 1 and 2 utilizes a mechanical joining of the tube plate 18 and the tank 27 that includes a gasket or seal 60, it may be advantageous in some applications for the connection between the tank plate 18 and the tank 27 to be a braze joint of any suitable construction, particularly when the remainder of the heat exchanger includes braze coated or braze plated aluminum for a furnace brazing operation. As another example, while the illustrated tube plate 18 has a somewhat planar configuration, it may be advantageous in some applications for the tube sheet to have a U-shape cross section that is closed using a cover plate to form a manifold for the heat exchanger. As yet a further example, in some applications it may be advantageous to form the tube plate 18 and the tank 27 as an integral sheet that is closed by a longitudinal seam, such as a longitudinal braze joint.

What is claimed is:

1. A heat exchanger construction comprising:

a header plate including an interior side, an exterior side, and a plurality of tube openings spaced along a first axis and extending between the interior and exterior sides;

a plurality of elongated flat tubes, each tube having a pair of opposed long sides and a pair of opposed short sides, each of the tubes having an end received in one of the tube openings extending past the interior side, each end including a pair of long edges defined by the long sides, each tube having a cut in each of its short sides extending from the end to adjacent the interior side of the header plate, each tube having a bend formed in each of the long sides of the tube adjacent the cut so that the long edges of the tube are adjacent the long edges of the tubes on either side of the tube wherein the long edges of each tube are overlapped with the long edges of the tubes on either side of the tube.

2. The heat exchanger construction of claim 1 wherein each of the bends is a substantially 90° bend.

3. The heat exchanger construction of claim 1 wherein each of the tube openings includes a peripheral flange on the interior side of the header plate.

4. The heat exchanger construction of claim 1 wherein each of the long sides between the long edges and the bends of the tubes are substantially parallel to said first axis.

5. A heat exchanger construction comprising:

a header plate including an interior side, an exterior side, and a plurality of tube openings spaced along a first axis and extending between the interior and exterior sides;

a plurality of elongated flat tubes, each tube having a pair of opposed long sides and a pair of opposed short sides, each of the tubes having an end received in one of the tube openings extending past the interior side, each end including a pair of long edges defined by the long sides, each tube having a cut in each of its short sides extending from the end to adjacent the interior side of the header plate, each tube having a bend formed in each of the long sides of the tube adjacent the cut so that the long edges of the tube are adjacent the long edges of the tubes on either side of the tube; and a tank surrounding the interior side and the tube ends and including an inlet opening for a working fluid, and wherein for each adjacent pair of long edges the long edge of the closer to the inlet opening overlays the long edge of the next tube further from the inlet opening.

* * * * *